US009350120B2

(12) United States Patent
Aoki

(10) Patent No.: US 9,350,120 B2
(45) Date of Patent: May 24, 2016

(54) PLUG CONNECTOR AND METHOD OF MANUFACTURING THE SAME

(71) Applicant: DAI-ICHI SEIKO CO., LTD., Kyoto (JP)

(72) Inventor: Hideki Aoki, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 14/284,550

(22) Filed: May 22, 2014

(65) Prior Publication Data

US 2014/0357123 A1 Dec. 4, 2014

(30) Foreign Application Priority Data

Jun. 3, 2013 (JP) ..... 2013-117105

(51) Int. Cl.
*H01R 9/03* (2006.01)
*H01R 13/6581* (2011.01)
*H01R 13/6593* (2011.01)

(52) U.S. Cl.
CPC ..... *H01R 13/6581* (2013.01); *H01R 13/6593* (2013.01); *Y10T 29/49208* (2015.01)

(58) Field of Classification Search
CPC .... H01R 13/6581; H01R 12/79; H01R 12/77; H01R 12/88
USPC ..... 439/607.55
See application file for complete search history.

(56) References Cited

U.S. PATENT DOCUMENTS

2002/0192998 A1* 12/2002 Noro ..... H01R 13/6592 439/497
2011/0076887 A1* 3/2011 Miyazaki ..... H01R 12/592 439/607.55

(Continued)

FOREIGN PATENT DOCUMENTS

CN 1392636 A 1/2003
CN 1794518 A 6/2006

(Continued)

OTHER PUBLICATIONS

Combined Office Action and Search Report issued Dec. 2, 2015 in Chinese Patent Application No. 201410236213.4 (with English Translation of Category of Cited Documents).

*Primary Examiner* — Abdullah Riyami
*Assistant Examiner* — Nader J Alhawamdeh
(74) *Attorney, Agent, or Firm* — Oblon, McClelland, Maier & Neustadt, L.L.P

(57) ABSTRACT

To make it possible to connect a flat signal-transmission medium to a plug connector efficiently and surely with a simple configuration where the number of components are reduced. A pair of shell pieces where a flat signal-transmission medium is inserted are connected openably and closably by shell connecting parts, and in at least one of the shell pieces, a retaining engaging pawl which is engaged with a part of the flat signal-transmission medium and holds the flat signal-transmission medium when a closed state is made is provided, and only by making a conductive shell into the closed state after the flat signal-transmission medium is made to be inserted into the conductive shell 11 which is in an opened state, the retaining engaging pawl is made to be into an engagement state with a part of the flat signal-transmission medium and the flat signal-transmission medium is held without a backlash in the conductive shell, and thereby, attaching of the flat signal-transmission medium is configured to be performed easily and satisfactorily.

8 Claims, 19 Drawing Sheets

(56) References Cited

U.S. PATENT DOCUMENTS

| | | | | |
|---|---|---|---|---|
| 2011/0177717 | A1* | 7/2011 | Lin | H01R 9/05 439/607.55 |
| 2012/0003866 | A1* | 1/2012 | Yamaji | H01R 13/405 439/527 |
| 2012/0252252 | A1* | 10/2012 | Yamaji | H01R 13/6581 439/310 |
| 2013/0164977 | A1* | 6/2013 | Huang | H01R 13/6581 439/607.01 |

FOREIGN PATENT DOCUMENTS

| | | | | |
|---|---|---|---|---|
| CN | 102142631 | A | 8/2011 | |
| CN | 102195162 | A | 9/2011 | |
| EP | 2365588 | A1 * | 9/2011 | |
| JP | 3931684 | B2 | 6/2007 | |
| JP | 2011-187367 | | 9/2011 | |
| JP | EP 2365588 | A1 * | 9/2011 | H01R 12/775 |
| JP | EP 2637257 | A1 * | 9/2013 | H01R 12/774 |

* cited by examiner

PLUG CONNECTOR AND METHOD OF MANUFACTURING THE SAME

BACKGROUND OF THE INVENTION

1. Field of the Invention

The present invention relates to a plug connector which is configured so that a terminal portion of a flat signal-transmission medium which projects from a conductive shell may be inserted into an opposing connector, and to a method of manufacturing the same.

2. Description of the Related Art

Generally, in various electric appliances or the like, it is performed widely that a terminal portion of various flat signal-transmission mediums formed so as to make a slender plate shape such as a flexible printed circuit (FPC) and a flexible flat cable (FFC) is made to have been connected to a plug connector, and the plug connector where the flat signal-transmission medium is connected is made to be inserted and fitted to a receptacle connector as an opposing connector mounted on a printed wiring board, and thereby, electric connection is performed.

While the plug connector at this time is generally configured so as to cover both the front and back surfaces of an insulating base (insulating housing) with a pair of conductive shells, a connection terminal (contact) with a signal line or a ground line exposed is formed so as to make a multipolar electrode part in the terminal portion of the flat signal-transmission medium, and those multipolar electrode parts are arranged so as to project from the conductive shell.

In the case of performing attaching of the above mentioned plug connector, the terminal portion of the flat signal-transmission medium is attached to the insulating base (insulating housing) first, and after the insulating base which is in a state with this flat signal-transmission medium connected is attached to one conductive shell, the other conductive shell is attached so as to carry out covering from the upper side, and thereby, harness manufacturing is performed. In addition, since the flat signal-transmission medium of this state has a possibility of generating a backlash against the flat signal-transmission medium or the insulating base (insulating housing), a fixed state of the flat signal-transmission medium is secured by using a fixing means such as a tape or the like.

On the other hand, the present applicant discloses a connector device which does not need the insulating base (insulating housing) in a prior art document described below. However, also in a manufacturing process of the plug connector according to Japanese Patent Laid-open No. 2011-187367, at least 3 processes, i.e., a setting process of the flat signal-transmission medium for one conductor-made shell, an attachment process of the other conductive shell, and an adding process of a fixing means are needed, and further enhancement of attachment workability such as performing reduction of the number of processes is required.

Herein, we disclose Japanese Patent Laid-open No. 2011-187367 as a close prior art document to the present invention.

Then, the object of the present invention is to provide a plug connector and a method of manufacturing the same where the flat signal-transmission medium can be connected efficiently and surely in a simple configuration.

SUMMARY OF THE INVENTION

In order to achieve the above-mentioned object, as for the plug connector according to the present invention, it is configured that: in a plug connector which is attached so that a terminal portion of a flat signal-transmission medium projects from a conductive shell and is configured so that a part including a terminal portion of the flat signal-transmission medium is inserted into an opposing connector, the conductive shell is comprised of a pair of shell pieces where a terminal portion of the flat signal-transmission medium is received, and is configured so that a terminal portion of the flat signal-transmission medium is inserted into a medium receiving space formed of the pair of shell pieces, and the pair of shell pieces are connected openably and closably via a shell connecting part arranged at a far-end in an insertion direction of the flat signal-transmission medium, and in at least one of the shell pieces, provided is a retaining engaging pawl which is engaged with a part of the flat signal-transmission medium and holds the flat signal-transmission medium when the pair of shell pieces are brought into a closed state from an opened state.

According to the configuration like this, after the flat signal-transmission medium is inserted into the medium receiving space of the conductive shell where a pair of shell pieces are in the opened state, only by making a pair of shell pieces into a closed state, the retaining engaging pawl will be in an engagement state with a part of the flat signal-transmission medium, and the flat signal-transmission medium is held without a backlash against the conductive shell owing to an engagement force of this retaining engaging pawl, and thereby, attaching of the flat signal-transmission medium is performed easily and satisfactorily.

In addition, in the present invention, the plug connector is configured preferably so that the shell connecting part is formed as an abutment part for the flat signal-transmission medium inserted into the medium receiving space, and a part of the flat signal-transmission medium is positioned by the shell connecting part as the abutment part and the retaining engaging pawl.

According to the configuration like this, the shell connecting part as an abutment part and the retaining engaging pawl will come in contact with a part of the flat signal-transmission medium from the front and rear of the insertion direction, and thereby, the retentivity of the flat signal-transmission medium is enhanced.

In addition, the retaining engaging pawl in the present invention preferably has enough elasticity to press the flat signal-transmission medium toward the insertion direction.

According to the configuration like this, the retaining engaging pawl comes in a contact state so as to press elastically the flat signal-transmission medium, and thereby, holding of the flat signal-transmission medium is performed smoothly.

In addition, in the present invention, in a terminal portion of the flat signal-transmission medium, a connection terminal brought into contact with an opposing connector is provided so as to form a multipolar electrode part, and on a surface of the conductive shell, a short circuit prevention part which holds the conductive shell in a non-contact state with the connection terminal is provided, and this short circuit prevention part is preferably arranged so as to be faced to an insulation portion of the flat signal-transmission medium inserted into the medium receiving space.

According to the configuration like this, when the conductive shell is deformed by an external force or the like, the short circuit prevention part abuts on the insulation portion of the flat signal-transmission medium, and thereby, the conductive shell becomes prevented from being deformed any more, and the conductive shell is prevented from coming in contact with the connection terminal, and thereby, an electrical short of a transmission signal is avoided.

In addition, in the metal shell in the present invention, a sliding contact elastic spring member which abuts on a side end surface of the flat signal-transmission medium in a plate width direction and bends elastically when the flat signal-transmission medium is inserted is preferably provided.

According to the configuration like this, the flat signal-transmission medium inserted into the medium receiving space of the conductive shell will be moved owing to an elastic bias force of the sliding contact elastic spring member up to a position determined in advance in the plate width direction, and this flat signal-transmission medium is made to be held in an appropriate position in the plate width direction irrespective of an initial state when the flat signal-transmission medium is inserted.

In addition, in the present invention, the sliding contact elastic spring member is provided in one of the shell pieces, and the sliding contact elastic spring member is arranged in a positional relation where the sliding contact elastic spring member interferes with the other shell piece when the pair of shell pieces are closed in a state where the flat signal-transmission medium is not inserted into the medium receiving space, and the sliding contact elastic spring member is displaced by the flat signal-transmission medium inserted into the medium receiving space up to a position where the sliding contact elastic spring member does not interfere with the shell piece of the other side, and thereby, the sliding contact elastic spring is preferably configured not to interfere with the shell piece of the other side when the pair of shell pieces are closed in a state where the flat signal-transmission medium is inserted into the medium receiving space.

When such a configuration is adopted, since a pair of shell pieces are prevented from coming into a closed state against intention due to careless contact or the like in a manufacturing stage or during movement and conveyance of the conductive shell, for example, a situation where the flat signal-transmission medium has been unable to be inserted is prevented, and a so-called lowering of a yield during manufacturing is prevented.

In addition, in the flat signal-transmission medium in the present invention, a positioning part formed so as to project or become depressed in a plate width direction or a plate thickness direction of the flat signal-transmission medium is provided, and the retaining engaging pawl is preferably configured to be engaged with the positioning part.

According to the configuration like this, engagement of the retaining engaging pawl with the flat signal-transmission medium will be surely performed via the positioning part, and the retentivity of the flat signal-transmission medium is enhanced.

In addition, in a method of manufacturing a plug connector according to the present invention, a configuration where two or more bodies of the above mentioned conductive shells are connected and manufactured integrally is adopted.

According to such manufacturing method, two or more conductive shells will be manufactured integrally, and manufacturing efficiency is enhanced substantially.

As for the present invention as described above, a pair of shell pieces which form the medium receiving space where the terminal portion of the flat signal-transmission medium is inserted are connected openably and closably by the shell connecting part, and in at least one side of a pair of shell pieces, the retaining engaging pawl which is engaged with a part of the flat signal-transmission medium and holds the flat signal-transmission medium when this pair of shell pieces are brought into a closed state from an opened state is provided, and only by making the conductive shell into a closed state after the flat signal-transmission medium is inserted into a receiving space of the conductive shell where a pair of shell pieces are in an opened state, the retaining engaging pawl is brought into an engagement state with a part of the flat signal-transmission medium, and the flat signal-transmission medium is held without a backlash in the conductive shell, and thereby, attaching of the flat signal-transmission medium is configured to be performed easily and satisfactorily, and therefore, the flat signal-transmission medium can be connected efficiently and surely to the plug connector with a simple configuration where the number of components are reduced, and productivity and reliability of an electrical connector can be substantially enhanced at low cost.

DETAILED DESCRIPTION OF THE PREFERRED EMBODIMENTS

Hereinafter, an embodiment of the present invention will be described in detail based on drawings.

[With Respect to Electrical Connector Assembly]

Figure 1:
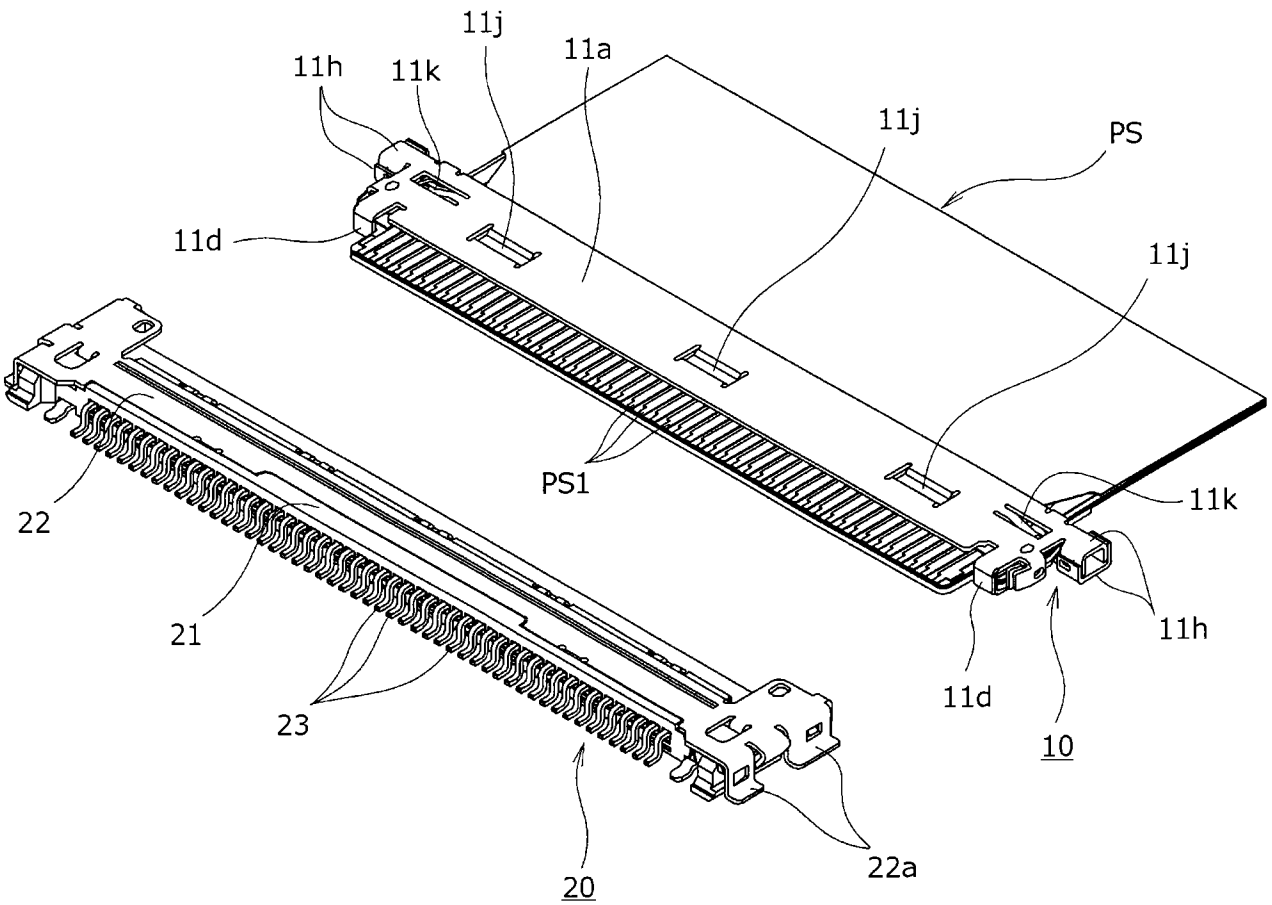
FIG. 1 is an external perspective explanatory view illustrating a state where a plug connector according to an embodiment of the present invention with a flat signal-transmission medium (FPC, FFC) inserted is brought to be close to a receptacle connector as an opposing connector.
Figure 2:
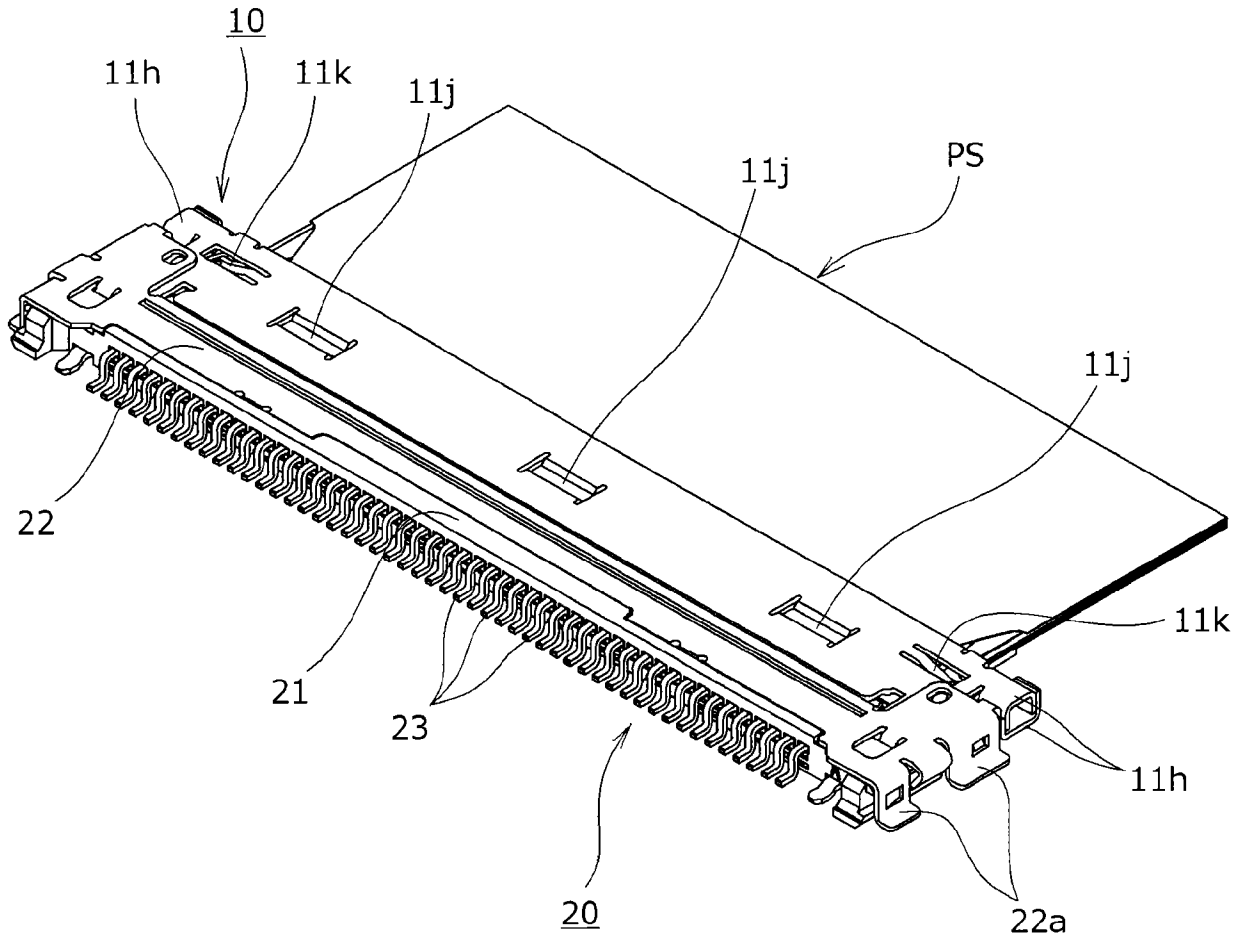
FIG. 2 is an external perspective explanatory view illustrating a state where the plug connector is brought to be inserted and fitted to the receptacle connector from the state of FIG. 1.

An electrical connector assembly according to an embodiment of the present invention illustrated in FIGS. 1 to 18 is one which is used for connecting a terminal portion of a flat signal-transmission medium PS made up of a flexible printed circuit (FPC) or a flexible flat cable (FFC) or the like to an electronic circuit on a printed wiring board whose illustration is omitted, and a plug connector 10 according to an embodiment of the present invention where the terminal portion of the flat signal-transmission medium PS is connected as illustrated in FIG. 1 and FIG. 2 in particular is inserted in an approximately horizontal direction into a receptacle connector 20 as an opposing connector connected by soldering to a wiring pattern (illustration omitted) formed on the printed wiring board, and thereby, is brought into a fitted state.

In the following, an extending direction of a surface of the printed wiring board is assumed to be a "horizontal direction", and a direction perpendicular to the surface of the printed wiring board is assumed to be a "height direction". In addition, in the plug connector 10, an end edge part of a tip side in an inserting direction at the time of fitting is assumed to be a "front end edge part", and an end edge part of the side in the opposite side thereto where the terminal portion of the flat signal-transmission medium PS is connected is assumed to be a "rear end edge part". In addition, in the receptacle connector 20, an end edge part in the side where the plug connector 10 is inserted at the time of fitting is assumed to be a "front end edge part", and an end edge part in the opposite side is assumed to be a "rear end edge part". In addition, the plug connector 10 and receptacle connector 20 have a connector body part extending so as to make an elongated shape, and an extending direction of the connector body part is assumed to be referred to as a "connector longitudinal direction".

In addition, the flat signal-transmission medium (FPC, FFC) PS extending from the rear end edge part of the plug connector 10 to a rear side thereof is connected while the above mentioned "connector longitudinal direction" is assumed to be a "plate width direction", and is made up of a member extending in a direction perpendicular to the "plate width direction", where two or more signal lines and ground lines (shielding wire) are arranged adjacently so as to make a multipolar along the "plate width direction".

[With Respect to Plug Connector]

Figure 3:
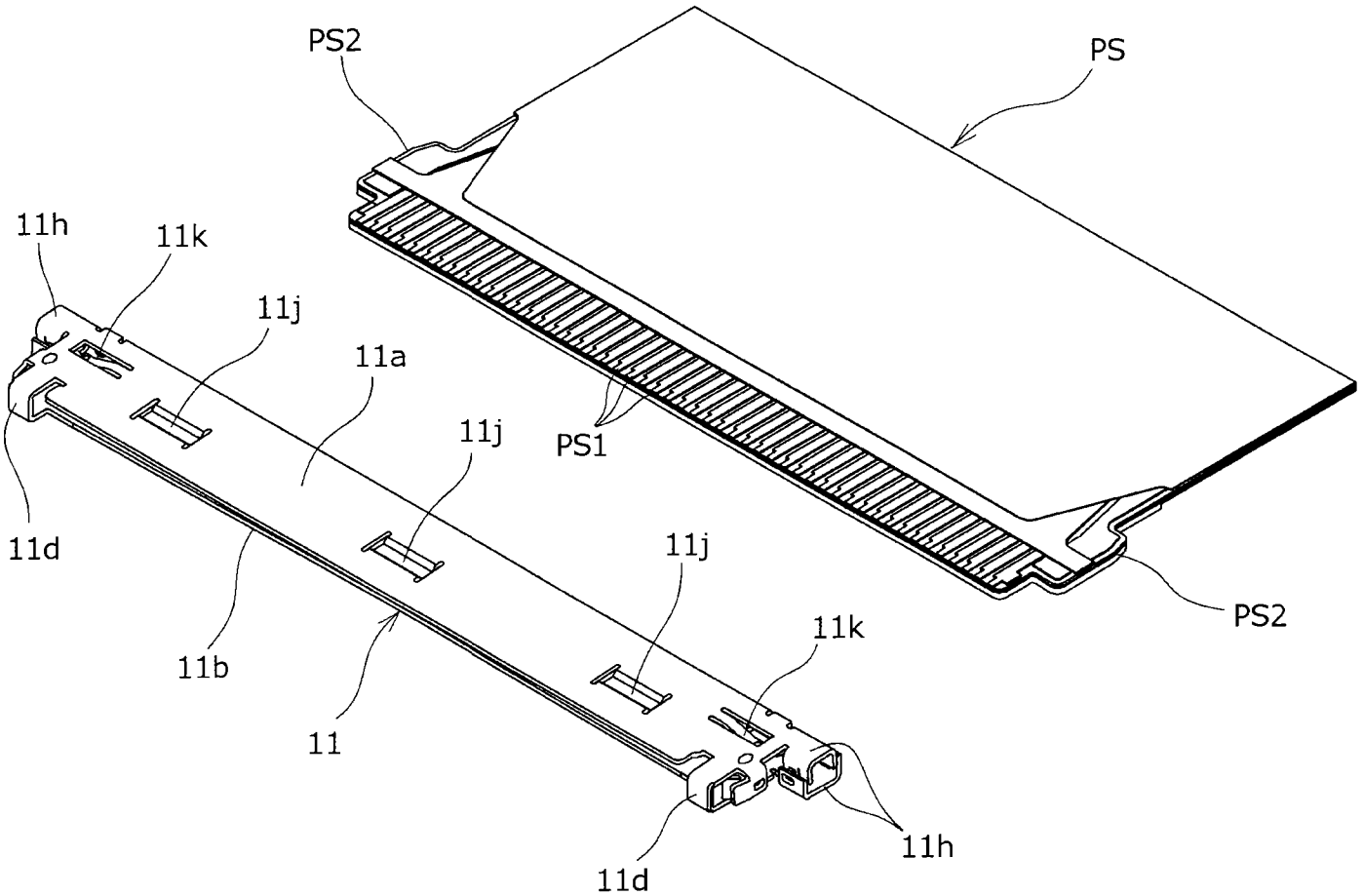
FIG. 3 is an external perspective explanatory view illustrating a state where the flat signal-transmission medium (FPC, FFC) is removed from the plug connector according to an embodiment of the present invention illustrated in FIGS. 1 and 2.

The connector body part of the plug connector 10 constituting the electrical connector of one side of the electrical connector assembly like this does not have an insulating base (insulating housing) made up of insulating materials such as synthetic resin with which a general electrical connector is provided, and is brought to be a configuration where the terminal portion of the flat signal-transmission medium (FPC, FFC) PS is inserted and fixed within a medium receiving space formed in the inside of a conductive shell 11 for blocking off an electromagnetic wave noise or the like. The conductive shell 11 at this time, as illustrated in FIG. 3, is formed by an integral structure provided with an upper shell piece 11*a* and lower shell piece 11*b* which sandwich the terminal portion of the flat signal-transmission medium PS from the upper and lower sides, and the detailed structure will be described in the latter part.

[With Respect to Signal Transmission Medium]

Figure 10:
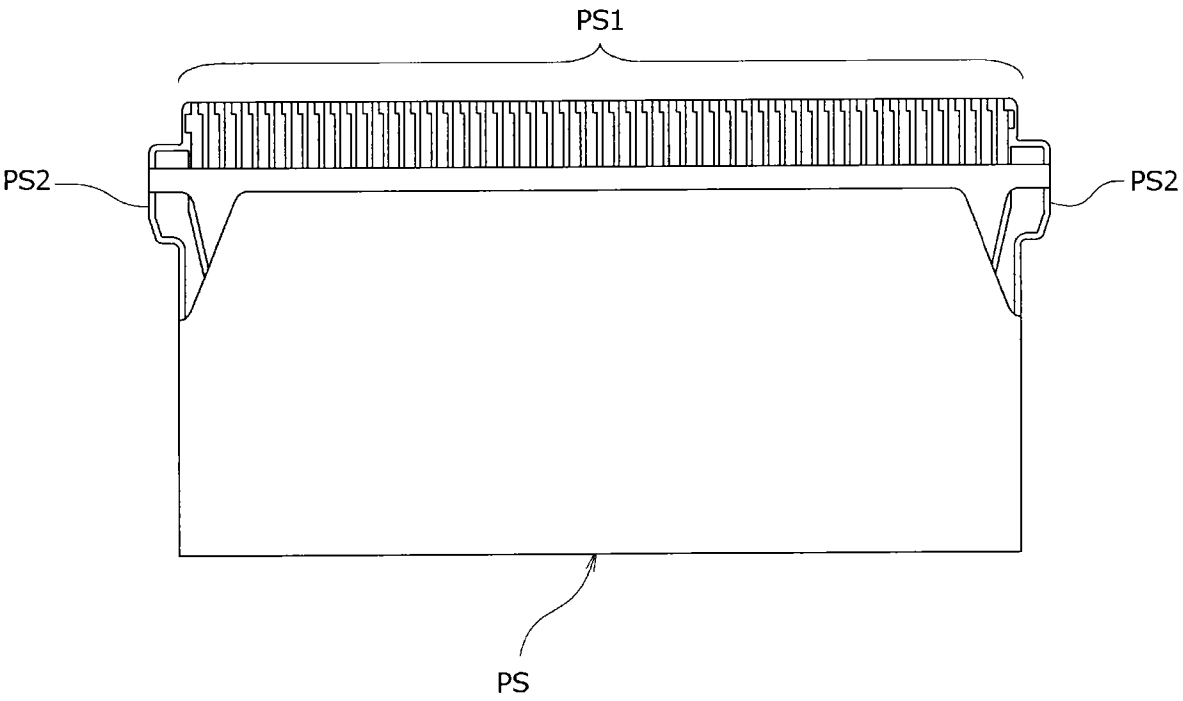
FIG. 10 illustrates a plane explanatory view of the flat signal-transmission medium (FPC, FFC) single body.
Figure 11:
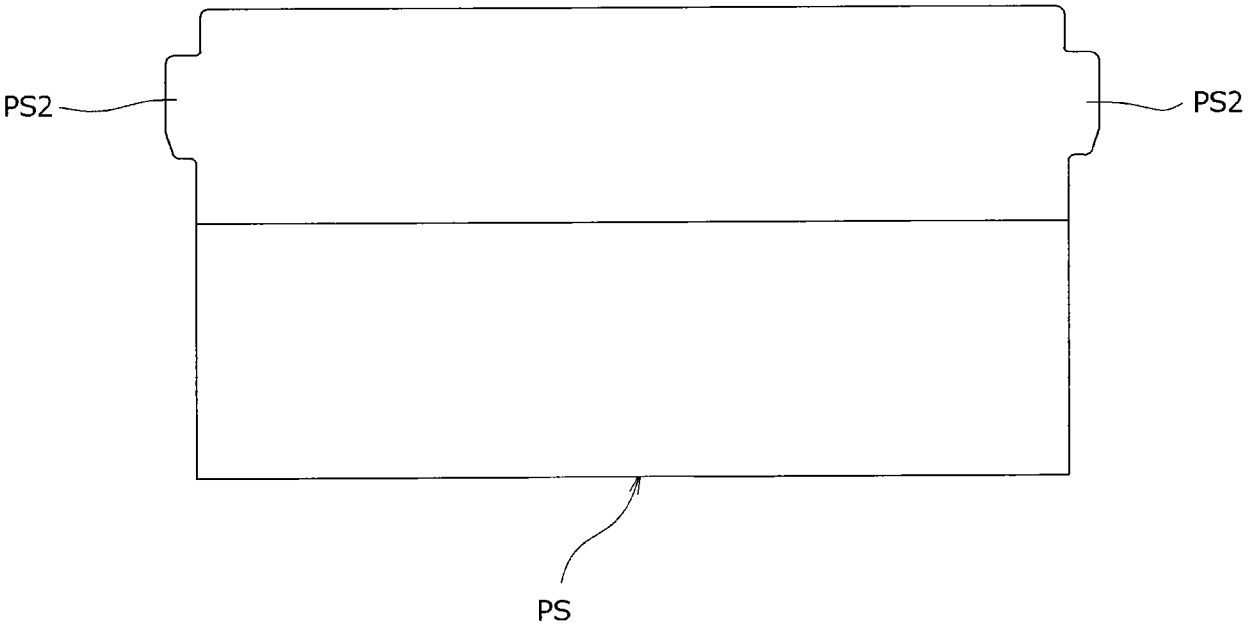
FIG. 11 illustrates a bottom explanatory view of the flat signal-transmission medium (FPC, FFC) single body.

On the other hand, as illustrated in FIGS. 10 and 11, as for the flat signal-transmission medium (FPC, FFC) PS, two or more signal lines and ground lines (shielding wire) are arranged along the plate width direction so as to make a multipolar in the inside of an insulating sheath material having flexibility as described above, and the insulating sheath member in the present embodiment is made to be a structure where an insulating cover film stuck so as to form a lower layer on the above mentioned signal lines and ground lines is used, and at the same time, a shield tape is laminated further on the insulating cover film so as to constitute an upper layer.

Then, the insulating sheath member like this is brought into a state where the insulating sheath member is removed in a fixed area at a tip edge side inserted into the medium receiving space of the plug connector 10, and thereby, an electrode part having the multipolar is formed. That is, the terminal portion of this flat signal-transmission medium PS is brought into a state where two or more signal lines and ground lines (shielding wire) are exposed to the upper side, and a multipolar electrode part made up of two or more connection terminal parts (contact part) PS1 is formed by the exposed portion of the signal line and ground line. Note that, on an underside portion (non-exposing side portion) of these connection terminal parts PS1, an insulating sheath material is laminated so as to cover the whole underside of the connection terminal parts PS1.

At this time, the connection terminal part PS1 in the present embodiment is provided with a ground terminal where a ground line is exposed in both-side portions in the plate width direction, and between the both ground terminals arranged in those both-side portions in the plate width direction, a signal line terminal formed by exposing the signal line is arranged so as to make a prescribed pitch. The terminal portion of the flat signal-transmission medium (FPC, FFC) PS having two or more connection terminal parts PS1 like this is inserted into the inside of the above mentioned conductive shell 11 and fixed therein, and in a fixed state of this flat signal-transmission medium PS, the connection terminal part (multipolar electrode part) PS1 is arranged so as to project toward the front of the front end edge of the conductive shell 11, and is configured to be inserted into the receptacle connector 20 as an opposing connector mentioned later and connected electrically.

In addition, in the both-side edges in the plate width direction of the flat signal-transmission medium (FPC, FFC) PS, positioning parts PS2 and PS2 are provided at portions corresponding to the slightly backward side of the above mentioned connection terminal part (multipolar electrode part) PS1. Each of these positioning parts PS2 is formed so as to project in the outward of the plate width direction in a planar and approximately rectangular shape, and the above mentioned ground terminal is formed so as to project on the upper surface of each of the positioning parts PS2. The ground terminal is covered partially with the insulating cover film constituting the lower layer of the insulating sheath member, and the shield tape constituting the upper layer is made to be formed in a shape where the positioning part PS2 is not covered by the both-side portions in the connector longitudinal direction being cut in a corner shape. In addition, a configuration where retaining engaging pawls 11*c* and 11*c* provided in the conductive shell 11 are engaged with each of these positioning parts PS2 as described later is made to be formed, and those retaining engaging pawls 11*c* and 11*c* are engaged with the positioning part PS2 and PS2 respectively, and thereby, the whole flat signal-transmission medium PS is configured to be held at a prescribed position determined in advance.

[With Respect to Conductive Shell]

Figure 6:
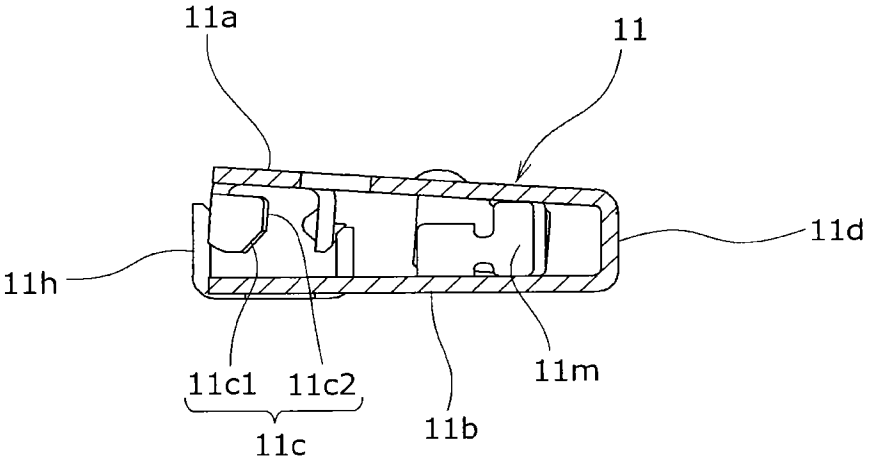
FIG. 6 illustrates a cross section explanatory view of the single body of the plug connector along a VI-VI line in FIG. 5.

On the other hand, as described above, the conductive shell 11 is formed of an upper shell piece 11*a* and lower shell piece 11*b* which sandwich the terminal portion of the flat signal-transmission medium (FPC, FFC) PS from the upper and lower sides as illustrated in FIGS. 3 and 6, and front end edge portions of those upper shell piece 11*a* and lower shell piece 11*b* are connected integrally by a pair of shell connecting parts 11*d* and 11*d* arranged at both-side portions in the connector longitudinal direction. Those shell connecting parts 11*d* and 11*d* are formed by bending a band plate shape member so that the side surface may make an approximate U-shape, and are formed as an abutment part in the insertion direction of the flat signal-transmission medium PS as described later. Then, the upper shell piece 11*a* and lower shell piece 11*b* connected integrally via the shell connecting parts 11*d* and 11*d* is configured to be openable and closable vertically.

More specifically, the above mentioned upper shell piece 11*a* and a lower shell piece 11*b* are configured to be opened and closed between a closed position where both are arranged approximately in parallel at a prescribed interspace and an opened position where the upper shell piece 11*a* is rotated so as to be raised upward on the shell connecting parts 11*d* and 11*d*, and in particular, in an initial state of the conductive shell 11, i.e., in a left state where an external force is not applied as illustrated in FIG. 6, are maintained by an elastic suspension force of the shell connecting parts 11*d* and 11*d* so that the upper shell piece 11*a* and the lower shell piece 11*b* may make a fixed angle, and are brought into a state where a back end portion of the conductive shell 11 is opened. In addition, the flat signal-transmission medium (FPC, FFC) PS is inserted in the inside of the medium receiving space formed in a parallel facing portion between the upper shell piece 11*a* and lower shell piece 11*b* which are brought into a state of an initial opened state like this, and thereafter, the upper shell piece 11*a* is held down downward from the upper side by an operator's fingertip, and thereby, the conductive shell 11 is brought into a closed state.

Figure 5:
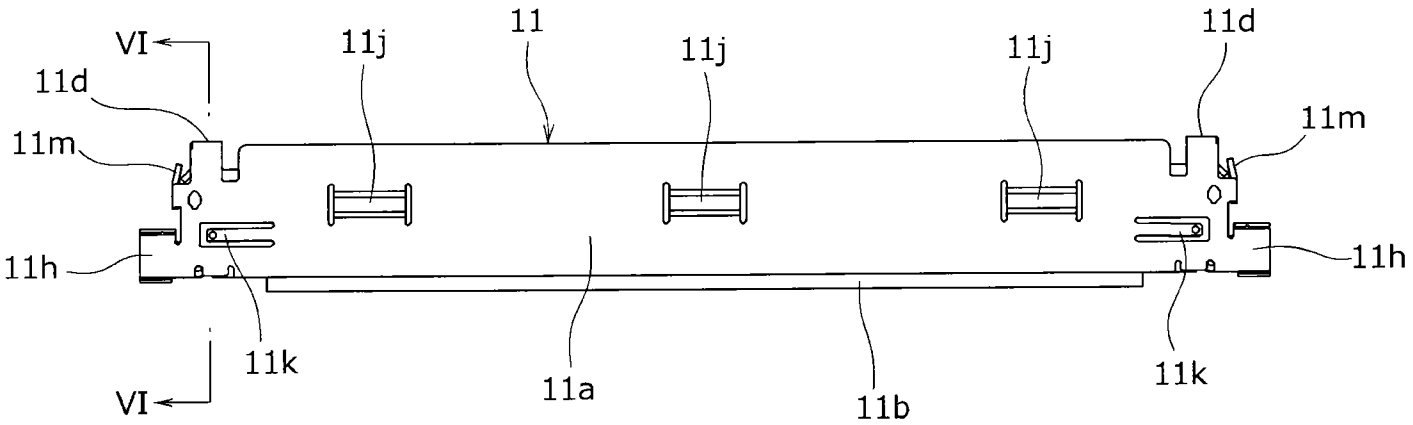
FIG. 5 illustrates a plane explanatory view of the plug connector single body illustrated in FIG. 4.
Figure 7:
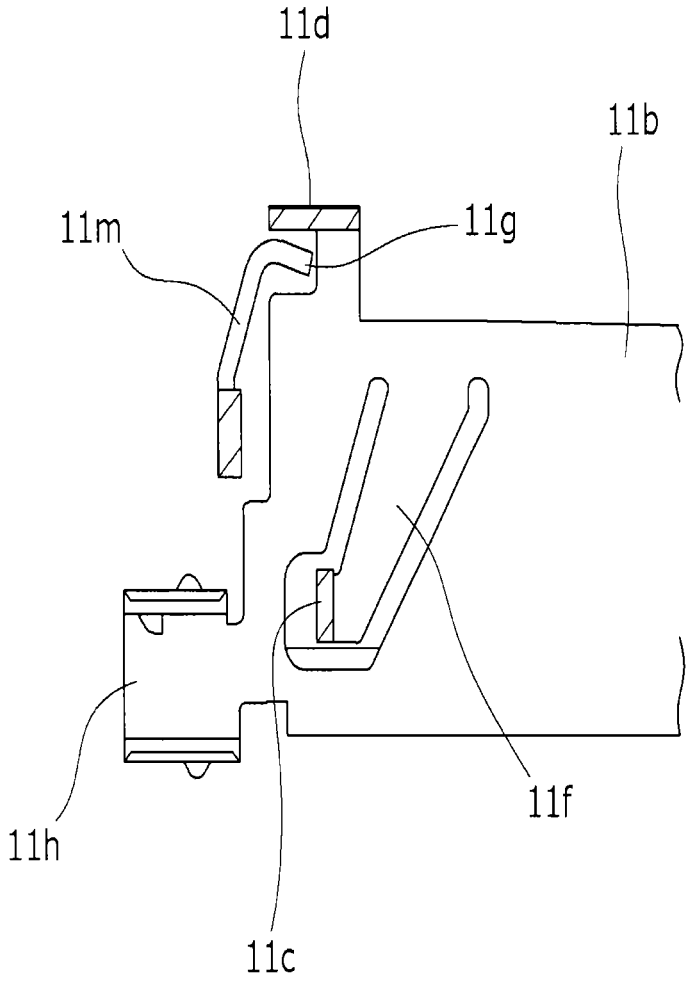
FIG. 7 is an plane explanatory view illustrating an internal structure of a lower shell piece in a state where an upper shell piece is removed in the plug connector single body according to FIG. 5.

As described above, both front end edges of the upper shell piece 11*a* and lower shell piece 11*b* are connect with each other integrally by a pair of shell connecting parts 11*d* and 11*d*, and in the back end portion in the opposite side of the front end portion of those upper shell piece 11 as and lower shell piece 11*b*, shell fixing parts 11*h* and 11*h* are formed so as to project outward at both-side portions in the connector longitudinal direction as illustrated in FIGS. 5 to 7. Each of these shell fixing parts 11*h* is one which is bent and formed so as to make an approximate U-shape in a side view, and is arranged so as to be opposed fittably vertically. Then, when the upper shell piece 11*a* is held down downward and the conductive shell 11 is brought into the closed state as described above, both shell fixing parts 11*h* and 11*h* are fitted to each other so as to be overlapped, and thereby, the whole conductive shell 11 including the upper shell piece 11*a* and lower shell piece 11 is configured to be fixed firmly. Note that, in a space between the shell fixing parts 11*h* and 11*h* of the upper shell piece 11*a* and lower shell piece 11*b*, an axis end of a locking bar which maintains a connected state after the plug connector 10 is connected with the receptacle connector 20 can be held.

Here, the shell connecting parts 11*d* and 11*d*, as described above, are a front end side portion of the conductive shell 11, i.e., a far-end in the insertion direction of the flat signal-transmission medium (FPC, FFC) PS, and are arranged at both-side portions in the connector longitudinal direction, and in the portion sandwiched by both the shell connecting parts 11*d* and 11*d*, a projected opening where the connection terminal part (multipolar electrode part) PS1 of the flat signal-transmission medium PS can penetrate is formed so as to extend in an elongated shape in the connector longitudinal direction.

In addition, in a rear end side portion of the conductive shell 11, i.e., a portion opposed to the above mentioned projected opening, an insertion opening where the connection terminal part (multipolar electrode part) PS1 of the flat signal-transmission medium PS can be inserted is formed so as to extend in an elongated shape in the connector longitudinal direction. This insertion opening is one which is formed in a state where the upper shell piece 11*a* is raised up and the conductive shell 11 is opened, and is formed so as to extend along the connector longitudinal direction in the portion sandwiched by both the shell connecting parts 11*d* and 11*d*.

Then, the connection terminal part PS1 of the flat signal-transmission medium PS (FPC, FFC) is inserted in the medium receiving space through the insertion opening provided in the rear end side in the conductive shell 11, and furthermore, the flat signal-transmission medium PS is going to be inserted toward the front side, and thereby, the connection terminal part PS1 of this flat signal-transmission medium PS projects so as to project toward the front side through the projected opening. In addition, at that time, the front end edge parts of the positioning parts PS2 and PS2 of the flat signal-transmission medium PS abut on the above mentioned shell connecting parts 11*d* and 11*d*, and thereby, the flat signal-transmission medium PS is configured to be positioned in the insertion direction. In this way, the shell connecting parts 11*d* and 11*d* make abutment parts for the insertion of the flat signal-transmission medium PS.

Figure 4:
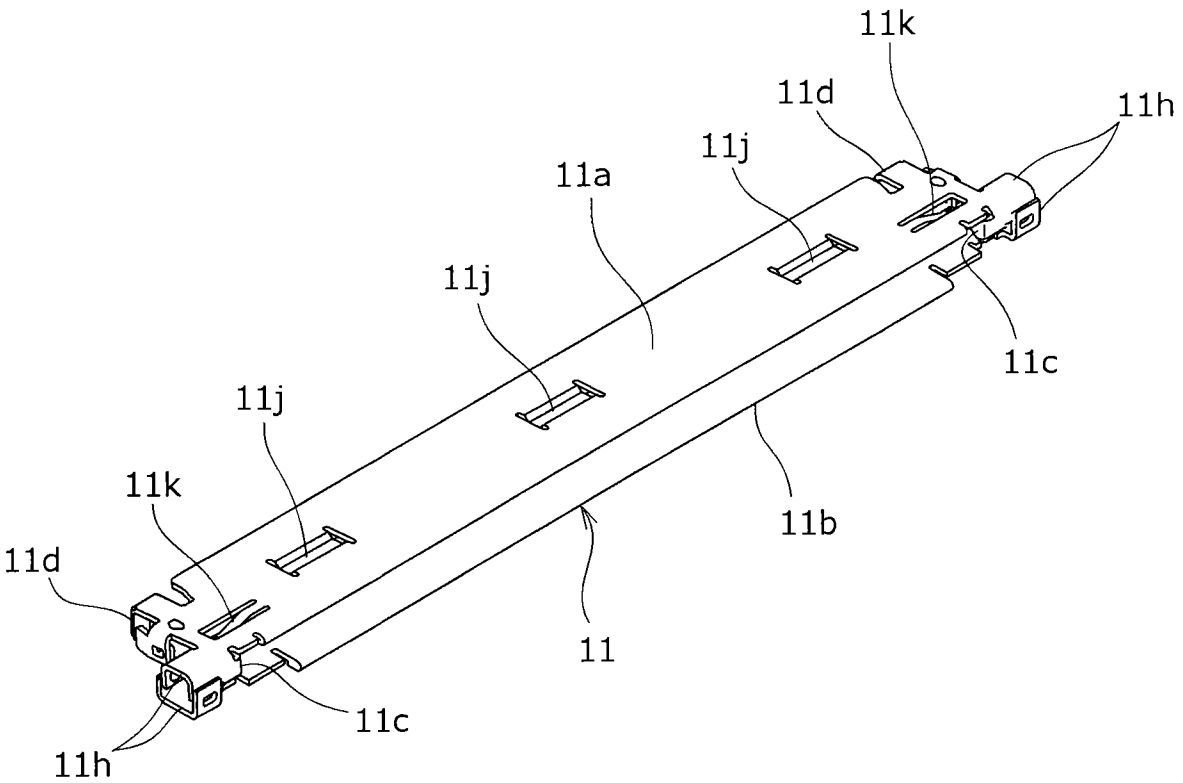
FIG. 4 illustrates an external perspective explanatory view of the plug connector single body according to FIG. 3 with the flat signal-transmission medium (FPC, FFC) removed.

In addition, as described above, at both-side outer portions in the connector longitudinal direction in the insertion opening of the conductive shell 11, shell fixing parts 11*h* and 11*h* are formed, and at portions of an inner end side where those shell fixing parts 11*h* and 11*h* adjoin the insertion opening, a pair of retaining engaging pawls 11*c* and 11*c* are formed as illustrated in FIGS. 4 and 6 in particular. A pair of these retaining engaging pawls 11*c* and 11*c* are formed in the upper shell piece 11*a*, and are formed of a belt-shape member extending from the position corresponding to an inner end (connector center side end) of the shell fixing parts 11*h* and 11*h* in this upper shell piece 11*a* toward a connector front side, and are formed so as to project toward the insertion opening side.

These retaining engaging pawls 11*c* and 11*c* are made to be a spring shaped member which extends in a cantilevered shape and has elastic flexibility, and at the front end edge part of each of these retaining engaging pawls 11*c*, an inclined guide side part 11*c*1 is formed so that a lower end side corner part of this retaining engaging pawl 11*e* may be cut in a corner shape. This inclined guide side part 11$c$1 extends toward the front side in an obliquely upward direction, and after that, a straight shape holding side part 11$c$2 extending in an approximately straight shape is formed. This straight shape holding side part 11$c$2 is one which forms the front end edge of the retaining engaging pawl 11$c$, and is extended vertically in the closed state of the conductive shell 11.

At this time, the above mentioned inclined guide side part 11$c$1 is configured to be in a positional relation to be capable of abutting on the rear end edge part in the positioning part PS2 of the flat signal-transmission medium (FPC, FFC) PS inserted into the medium receiving space of the conductive shell 11. The positional relation with respect to this point is as follows.

Figure 14:
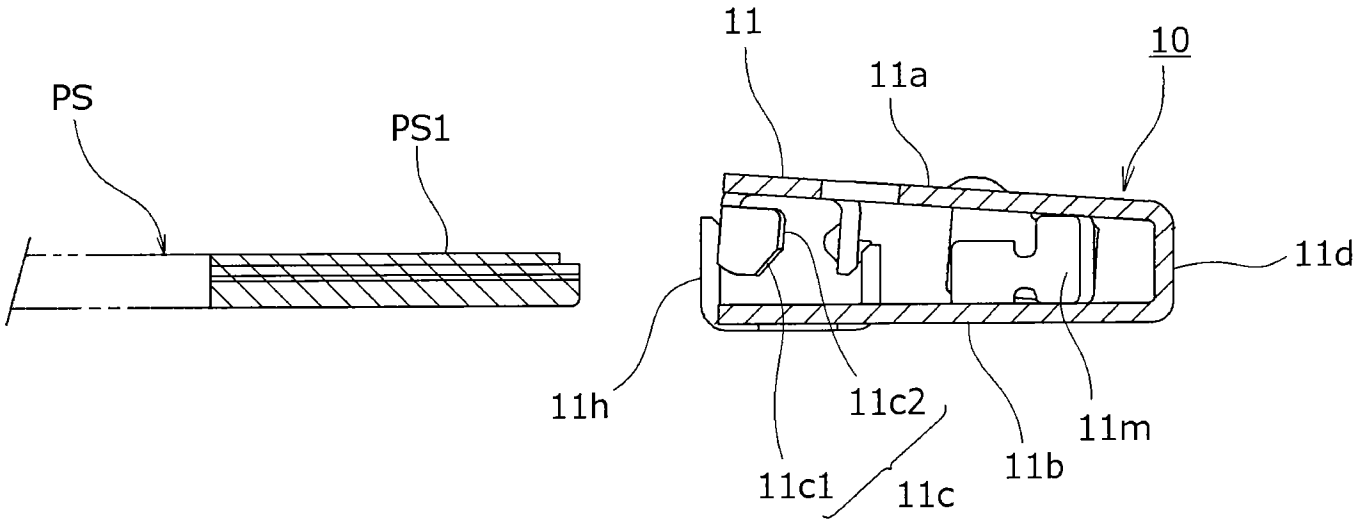
FIG. 14 is a cross section explanatory view equivalent to FIG. 6 illustrating a state where a terminal portion of the flat signal-transmission medium (FPC, FFC) is brought to be close to the plug connector single body according to an embodiment of the present invention.
Figure 15:
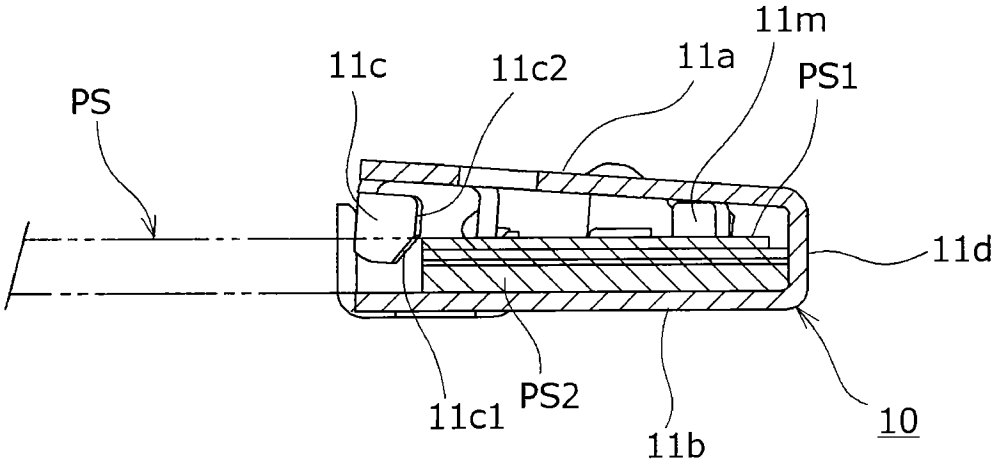
FIG. 15 is a cross section explanatory view equivalent to FIG. 6 illustrating a state where the terminal portion of the flat signal-transmission medium (FPC, FFC) is inserted from the state of FIG. 14 up to a final insertion point in the plug connector.

First, as illustrated in FIG. 14, when the flat signal-transmission medium PS is inserted into the medium receiving space in a state where the conductive shell 11 is opened in a initial state, the front end edge parts of the positioning part PS2 and PS2 of this flat signal-transmission medium PS abut on the shell connecting parts 11$d$ and 11$d$ as the abutment parts as illustrated in FIG. 15, and thereby, positioning in the insertion direction will be performed.

Figure 16:
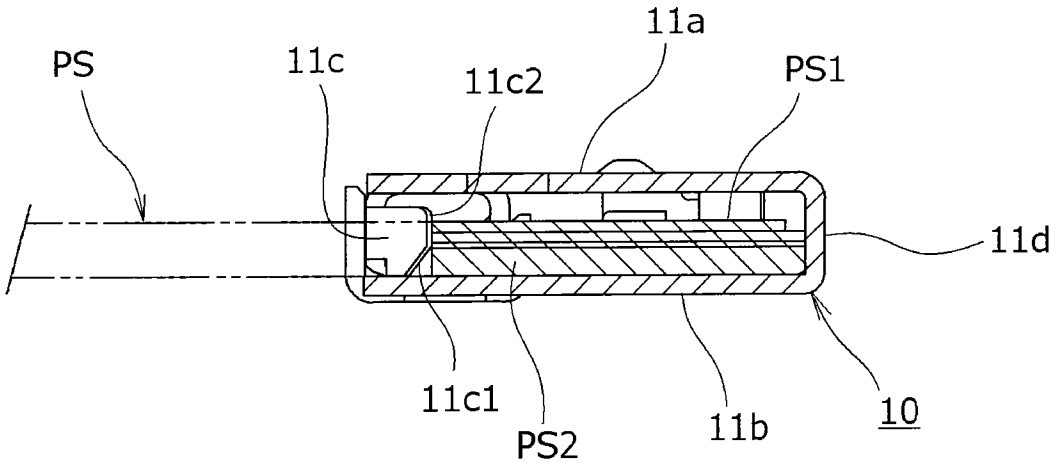
FIG. 16 is a cross section explanatory view equivalent to FIG. 6 illustrating a state where the plug connector is brought to be closed from the state of FIG. 15.
Figure 18:
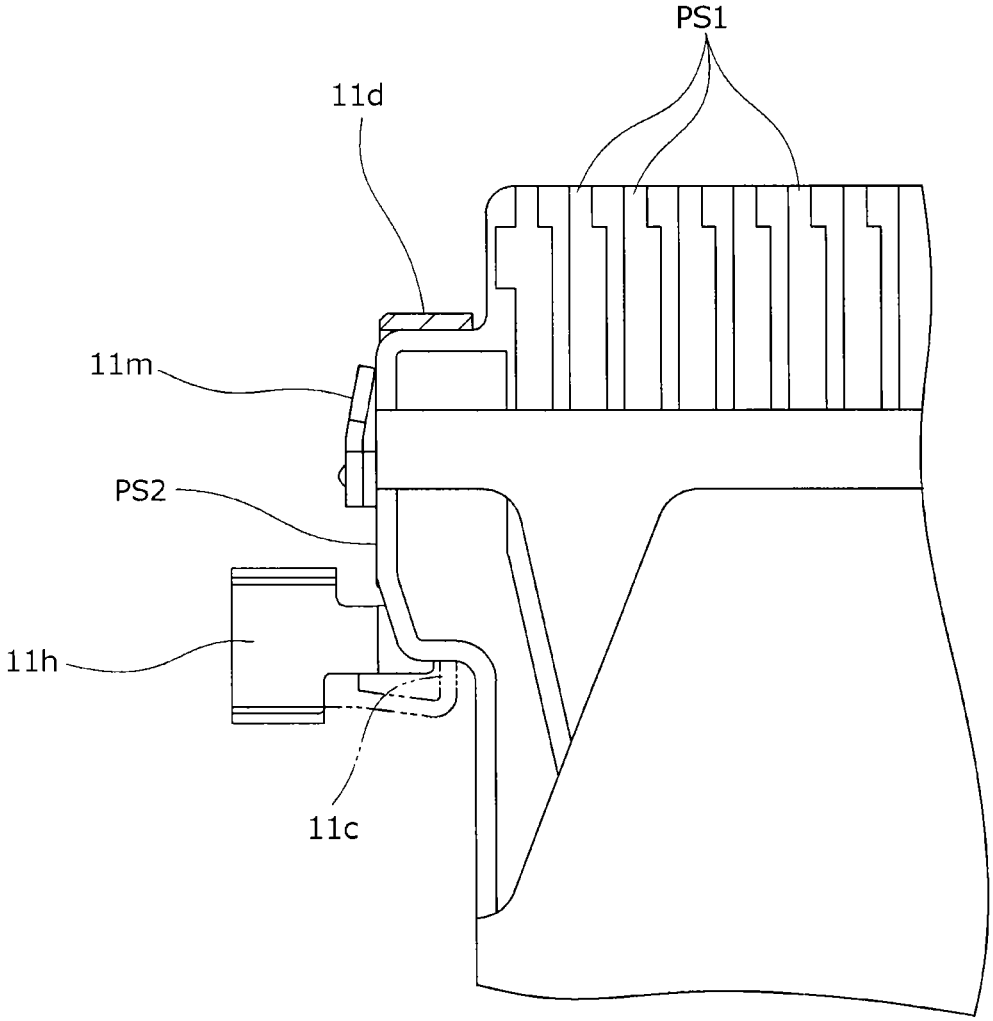
FIG. 18 is a plane explanatory view illustrated with a left end side portion of FIG. 13 enlarged in the internal structure of the plug connector single body illustrated in this FIG. 13.

Then, from such a final inserted state, the upper shell piece 11$a$ comes near to the lower shell piece 11$b$ while rotated in the downward closing direction, and then, a halfway position of the inclined guide side part 11$c$1 of the retaining engaging pawl 11$c$ is configured to be in a positional relation to abut on an insertion direction rear end edge in the positioning part PS2 of the flat signal-transmission medium PS. At this time, owing to a forward component force generated in this inclined guide side part 11$c$1, the whole flat signal-transmission medium PS will be pressed to the front side. In addition, when the closing operation of the upper shell piece 11$a$ progresses, as illustrated in FIGS. 16 and 18, the straight shape holding side part 11$c$2 of the retaining engaging pawl 11$c$ abuts on the insertion direction rear end edge part of the positioning part PS2, and thereby, the retaining engaging pawl 11$c$ becomes in an engagement state with the positioning part PS2, and the flat signal-transmission medium PS is held in an immovable state.

Figure 8:
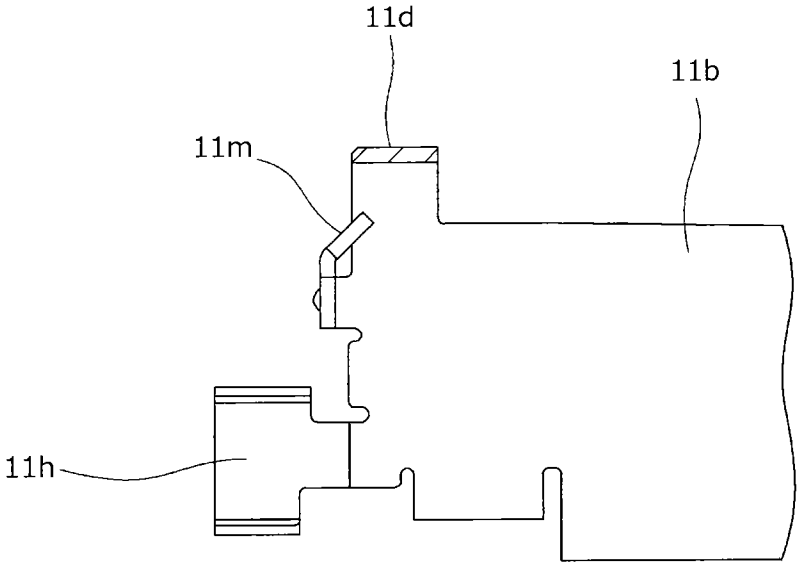
FIG. 8 is a plane explanatory view illustrated with a left end side portion of FIG. 7 enlarged in the internal structure of the plug connector single body illustrated in FIG. 7.

On the other hand, in an inner wall vicinity portion of the shell connecting parts 11$d$ and 11$d$ of the conductive shell 11 mentioned above, sliding contact elastic springs 11$m$ and 11$m$ which position in the plate width direction the flat signal-transmission medium (FPC, FFC) PS inserted from the insertion opening of the conductive shell 11 are provided as illustrated in FIGS. 7 and 8. Each of these sliding contact elastic springs 11$m$ is formed of a band plate shape member integrally provided in both end portions in the connector longitudinal direction of the lower shell piece 11$b$, and extends so as to be along an outer end edge of the positioning part PS2 of the flat signal-transmission medium PS.

More specifically, the above mentioned sliding contact elastic spring 11$m$ is formed of a cantilevered shape member extended toward an obliquely forward direction while both end edge parts in the connector longitudinal direction of the lower shell piece 11$b$ are made to be a base, and is formed of a band plate shaped spring member extending in an obliquely forward direction from the base toward a connector inward side (connector center side). Then, when the insertion of the flat signal-transmission medium (FPC, FFC) PS is performed as described above, as illustrated in FIGS. 13 and 18, a corner part of an insertion direction front end side of the positioning part PS2 provided in this flat signal-transmission medium PS is configured to be in a positional relation to abut on the halfway portion of the above mentioned sliding contact elastic spring 11$m$, and owing to an elastic force of this sliding contact elastic spring 11$m$, the whole flat signal-transmission medium PS including the positioning part PS2 will be moved to a position determined in advance in the plate width direction, and the positioning hereinafter in the plate width direction for the insertion of the flat signal-transmission medium PS is configured to be performed.

Figure 9:
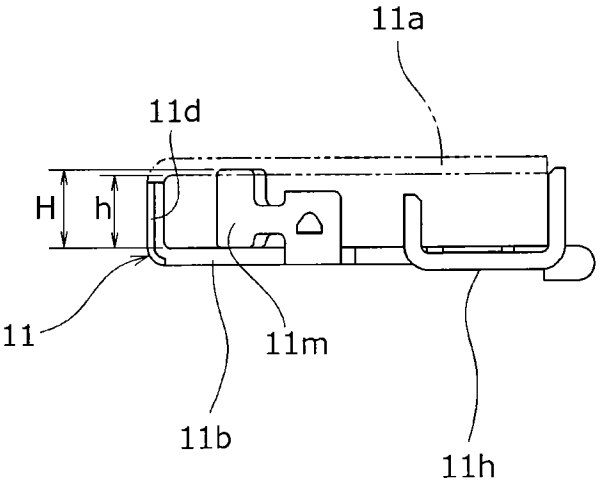
FIG. 9 is a side surface explanatory view illustrating a structure when the plug connector single body illustrated in FIG. 8 is viewed from a left side face.

At this time, as illustrated in FIG. 9 in particular, a height H of an upper edge part (upward end edge in FIG. 9) of the sliding contact elastic spring 11$m$ on the basis of a bottom part inner surface of the lower shell piece 11$b$ is formed so as to become higher than a height h of an inner surface of the upper shell piece 11$a$ (H>h), and when the upper shell piece 11$a$ is closed in a state where the insertion of the flat signal-transmission medium (FPC, FFC) PS has not been performed, a positional relation where a part of this upper shell piece 11$a$ interferes slightly with a part of outer peripheral end edge part (upper end edge part) which forms the sliding contact elastic spring 11$m$ is made to be configured. Note that, this interference relation between the sliding contact elastic spring 11$m$ and the upper shell piece 11$a$ will be dissolved when the insertion of the flat signal-transmission medium PS is performed, and this point will be described later.

As described above, in the present embodiment, when the upper shell piece 11$a$ is closed in a state where the insertion of the flat signal-transmission medium (FPC, FFC) PS has not been performed, the sliding contact elastic spring 11$m$ is configured to be slightly in the interference relation with the upper shell piece 11$a$, and thereby, the upper shell piece 11$a$ which is to be in an opened state originally will be prevented from having come into a closed state against intention before the flat signal-transmission medium PS is inserted into the medium receiving space, and acquired is an engagement preventing function to prevent a situation where the insertion of the flat signal-transmission medium PS becomes impossible because the upper shell piece 11$a$ has been engaged with the lower shell piece 11$b$. For example, since it is prevented beforehand that the upper shell piece 11$a$ or the lower shell piece 11$b$ will come into an engagement state (closed state) against intention due to a careless contact in a manufacturing stage or during movement and conveyance of the conductive shell 11, it becomes possible to prevent lowering of a yield during manufacturing.

On the other hand, after the flat signal-transmission medium PS has been inserted into the medium receiving space, the sliding contact elastic spring 11$m$ will be displaced to the outward side in the plate width direction owing to the above mentioned positioning operation by the positioning part PS2 of the flat signal-transmission medium PS, and this sliding contact elastic spring 11$m$ moves up to the position where a positional relation where the interference with the upper shell piece 11$a$ does not occur is achieved. As the result, an engagement operation from the opened state to the closed state between the upper shell piece 11$a$ and lower shell piece 11$b$ is performed and completed smoothly without generation of the interference with the sliding contact elastic spring 11$m$.

Figure 12:
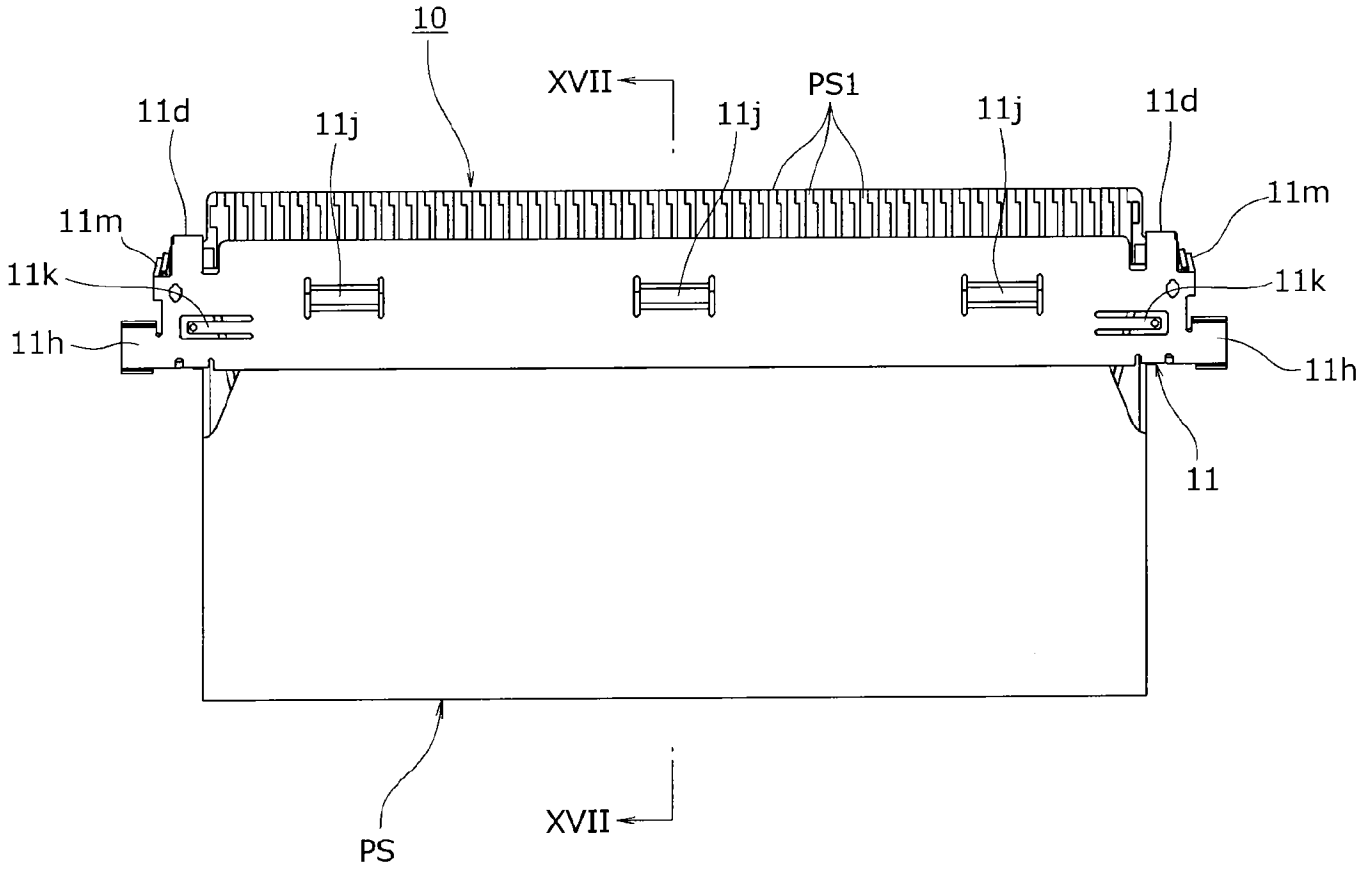
FIG. 12 illustrates the plug connector according to an embodiment of the present invention illustrated in FIGS. 1 and 2 and is a plane explanatory view illustrating a state where the flat signal-transmission medium (FPC, FFC) is inserted and attached.
Figure 13:
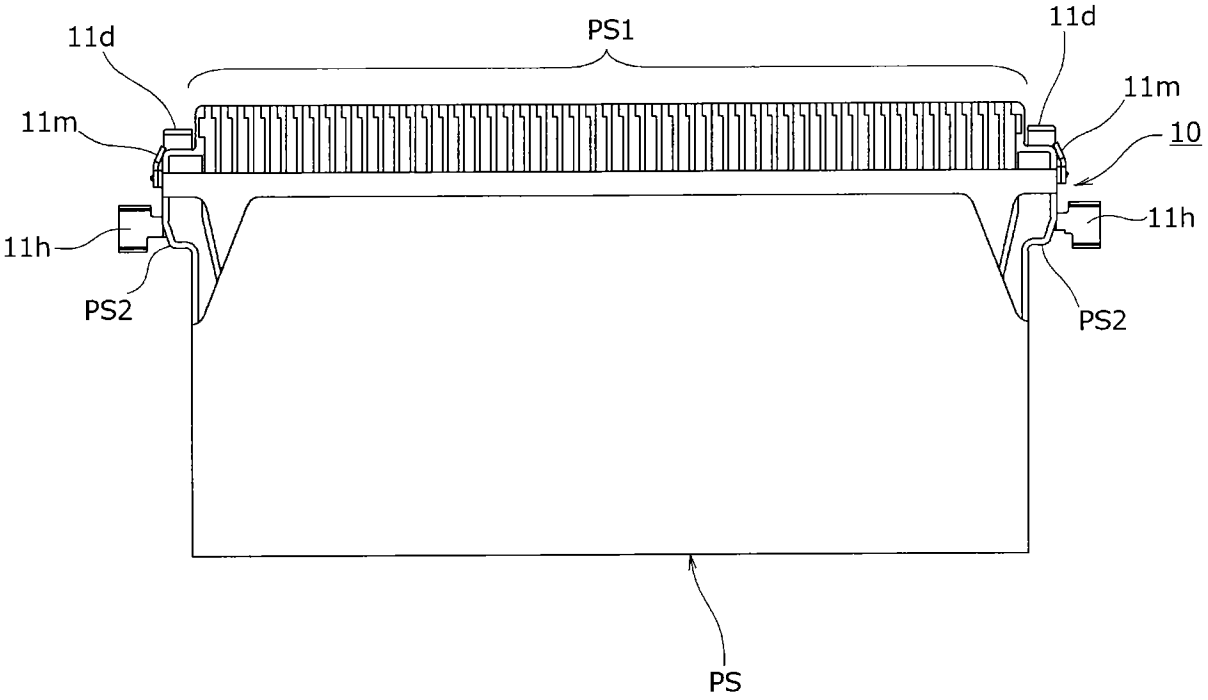
FIG. 13 is a plane explanatory view illustrating a state where the upper shell piece is removed in the plug connector illustrated in FIG. 12.
Figure 17:
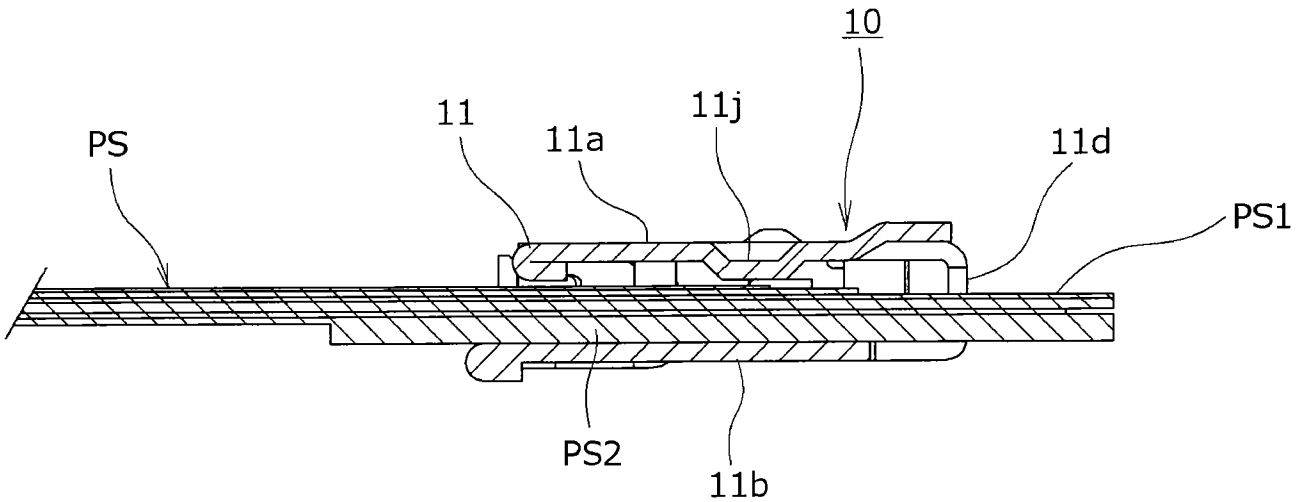
FIG. 17 illustrates a cross section explanatory view along a XVII-XVII line in FIG. 12.

In addition, as illustrated in FIGS. 12 and 17, in the upper shell piece 11$a$ in the conductive shell 11, a short circuit prevention part 11$j$ which holds the conductive shell 11 in a non-contact state with the connection terminal part PS1 is provided on the surface of this upper shell piece 11$a$ so that the three bodies may be in parallel along the connector longitudinal direction. Each of these short circuit prevention parts 11$j$ is formed of an inward projected part where press working has been carried out so as to be projected from the upper shell piece 11$a$ of the conductive shell 11 toward the inside of the medium receiving space, and is provided so that this each short circuit prevention part 11$j$ may be opposed from the upper side to an insulating sheath portion of the flat signal-transmission medium (FPC, FFC) PS inserted to the final position in the medium receiving space.

Furthermore, on the upper shell piece 11*a*, a pair of ground contacts 11*k* and 11*k* are formed at the outer portions in the connector longitudinal direction of the above mentioned short circuit prevention part 11*j*. Each of those ground contacts 11*k* is formed in a cutout shape so as to be projected in a cantilevered shape toward the medium receiving space in the inward side from the upper shell piece 11*a*. Each of these ground contacts 11*k* is made to have an arrangement relation where the ground contact 11*k* comes in contact with the connection terminal part (multipolar electrode part) PS1 which is located in the outermost part formed with ground lines of the flat signal-transmission medium (FPC, FFC) PS exposed, and is configured so that ground connection may be performed when the flat signal-transmission medium PS is inserted up to the final position.

[With Respect to Receptacle Connector]

On the other hand, the receptacle connector 20 constituting the opposing connector of the other side in the electrical connector assembly, as illustrated in FIGS. 1 and 2 in particular, has an insulating housing 21 formed from the insulating material such as synthetic resin, and at the same time, is provided with the conductive shell 22 which covers the exterior surface of the insulating housing 21 and blocks off the electromagnetic wave noise or the like from the outside.

In the insulating housing 21, two or more electric conduction contacts 23 are arranged in a suitable pitch interval so as to make a multipolar along the connector longitudinal direction. Each of those electric conduction contacts 23 is formed with a beam-shaped elastic metallic material bent, and is arranged so as to be extended in a front-back direction inside a groove portion provided in the above mentioned insulating housing 21. Each of these electric conduction contacts 23 is formed so that adjoining ones may make approximately the same shape.

On the other hand, at a rear end side portion of each of the electric conduction contacts 23, provided is a connecting leg part formed by bending so that a step shape may be made downwardly, and the connecting leg part is joined by soldering and connected electrically to a printed wiring pattern (electrically-conducting path) for signal transmission formed on the printed wiring board whose illustration is omitted. The joining by soldering at this time is performed integrally for all the connecting leg parts in a multi-electrode arrangement direction.

In addition, at the front end side portion of the above mentioned each electric conduction contact 23, a contact point part whose illustration is omitted is provided, and each of those contact point parts is made to be in an arrangement relation where the each contact point part is brought into contact elastically from the upper side with the connection terminal part PS1 of the plug connector 10 fitted to the receptacle connector 20, and thereby, a signal transmission circuit which reaches the printed wiring board via the connecting leg part from the contact point part is configured to be formed.

In addition, the conductive shell 22, in the upper and lower front end edge part thereof, is configured to come into surface contact elastically with the upper surface portion of upper shell piece 11*a* and the lower surface portion of lower shell piece 11*b* of the plug connector 10 fitted to this receptacle connector 20, and at the same time, at both end portions in the connector longitudinal direction in the conductive shell 22, two or more holddowns 22*a* are provided so as to extend approximately horizontally toward the outward side and rear end side in the connector longitudinal direction. These holddowns 22*a* are joined by soldering and connected electrically to the printed wiring pattern (electrically-conducting path) for grounding formed on the printed wiring board, and thereby, a ground circuit which reaches the printed wiring board from the conductive shell 22 is formed, and at the same time, the whole receptacle connector 20 is configured to be fixed.

In the plug connector 10 according to such embodiment, after the flat signal-transmission medium (FPC, FFC) PS is inserted into the medium receiving space of the conductive shell 11 through the insertion opening of the conductive shell 11 where the upper shell piece 11*a* and the lower shell piece 11*b* are brought into the opened state, only by carrying out operation so as to make the upper shell piece 11*a* and lower shell piece 11*b* in the closed state, the retaining engaging pawl 11*c* will be in the engagement state with the positioning part PS2 of the flat signal-transmission medium PS, and the flat signal-transmission medium PS will be held without a backlash against the conductive shell 11 owing to the engagement force of this retaining engaging pawl 11*c*, and thereby, attaching of the flat signal-transmission medium PS is performed easily and satisfactorily.

In the present embodiment at this time, the flat signal-transmission medium (FPC, FFC) PS inserted into the medium receiving space of the conductive shell 11 is moved up to the position determined in advance in the plate width direction owing to the elastic bias force of the sliding contact elastic spring member 11*m*, and thereby, this flat signal-transmission medium is held in an appropriate position in the plate width direction irrespective of the initial state when the flat signal-transmission medium PS is inserted.

In addition, in the present embodiment, the shell connecting parts 11*d* and 11*d* as the abutment part and the retaining engaging pawl 11*c* will come in contact with the positioning part PS2 of the flat signal-transmission medium PS from the front and rear in the insertion direction, and thereby, the retentivity of the flat signal-transmission medium PS is enhanced. Since the retaining engaging pawl 11*c* at this time has enough elasticity to press the flat signal-transmission medium PS toward the insertion direction, the retaining engaging pawl 11*c* comes in a contact state so as to press elastically the flat signal-transmission medium PS, and thereby, holding of the flat signal-transmission medium PS is performed smoothly.

In addition, in the present embodiment, when the conductive shell 11 is going to be deformed with an external force or the like applied, the short circuit prevention part 11*j* abuts on the insulating sheath portion of the flat signal-transmission medium (FPC, FFC) PS, and the conductive shell 11 becomes prevented from being deformed any more, and the conductive shell 11 will become prevented from coming in contact with the connection terminal part (multipolar electrode part) PS1 of the conductive shell 11, and non-conformities such as a electrical short of a transmission signal are configured to be avoided satisfactorily.

Figure 19:
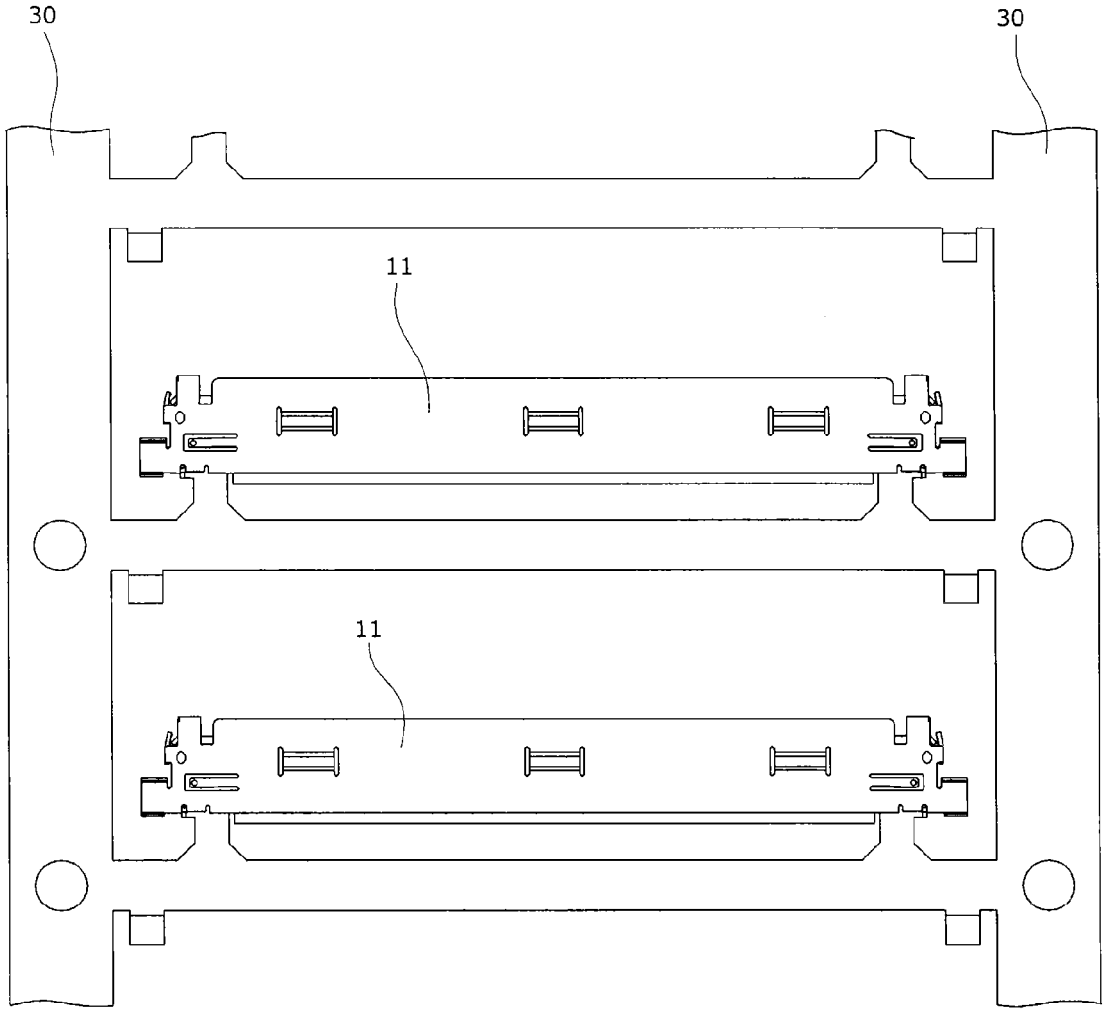
FIG. 19 is a plane explanatory view illustrating a manufacturing process of the conductive shell according to an embodiment of the present invention.

On the other hand, since the conductive shell 11 according to the above mentioned embodiment is formed integrally in the whole including the upper shell piece 11*a* and the lower shell piece 11*b*, adopting an intermediate step where two or more conductive shells 11 and 11, . . . are connected continuously by a carrier 30 is made to be possible as illustrated in FIG. 19. In this way, manufacturing of the conductive shell 11 is performed integrally, and thereby, the extremely efficient manufacturing becomes possible.

Although the invention made by the present inventor has been described specifically based on the embodiment as described above, the present embodiment is not limited to the above-mentioned embodiment, and it is needless to say that the present embodiment can be modified variously in the range without departing from the substance.

For example, although, in the above mentioned embodiment, the positioning part PS2 provided in the flat signal-transmission medium PS has been configured to be the shape projecting outward in the plate width direction, a shape depressed in the plate width direction is also possible, and a pillar-shaped one which projects in a plate thickness direction and a depressed hole shape are also possible.

In addition, although the connection terminal part (multipolar electrode part) in the above mentioned embodiment has been configured such that the ground terminal is arranged on the outside of the signal terminal, it is also possible as a matter of course that this ground terminal is configured to be the other arrangement relation to the signal terminal. In addition, a configuration having only a signal terminal where the ground terminal is removed is also possible.

In addition, although the retaining engaging pawl 11*c* in the above mentioned embodiment is provided in the upper shell 11*a*, the retaining engaging pawl 11*c* may be provided in other portions, for example on a side panel of the conductive shell.

Furthermore, although the above mentioned embodiment is one where the present invention is applied to a horizontally fitting type plug connector, the present invention is applicable similarly to a vertically fitting type plug connector.

As described above, it is possible that the present embodiment is applied widely to a large variety of electrical connectors used for various electric appliances.

What is claimed is:

1. A plug connector which is configured such that a terminal portion of a flat signal-transmission medium is attached to a conductive shell so as to project from the conductive shell and a first part including the terminal portion of the flat signal-transmission medium is inserted into an opposing connector, wherein the conductive shell is comprised of a pair of an upper shell piece and a lower shell piece where the terminal portion of the flat signal-transmission medium is received with a manner of sandwiching from the upper shell piece and the lower shell piece, and is configured so that the terminal portion of the flat signal-transmission medium is inserted into a medium receiving space formed of the pair of the upper shell piece and the lower shell piece, and the upper shell piece and the lower shell piece are connected openably and closably via a shell connecting part arranged at a far-end in an insertion direction of the flat signal-transmission medium, and the upper shell piece is provided with a retaining engaging pawl which is engaged with a second part of the flat signal-transmission medium and holds the flat signal-transmission medium when the upper shell piece and lower shell piece are brought into a closed state from an opened state.

2. The plug connector according to claim 1, wherein the plug connector is configured so that the shell connecting part is formed as an abutment part for the flat signal-transmission medium inserted into the medium receiving space, and a third part of the flat signal-transmission medium is positioned by the shell connecting part as the abutment part and the retaining engaging pawl.

3. The plug connector according to claim 2, wherein the retaining engaging pawl has enough elasticity to press the flat signal-transmission medium toward the insertion direction.

4. The plug connector according to claim 1, wherein a connection terminal brought into contact with the opposing connector is provided so as to form a multipolar electrode part in the terminal portion of the flat signal-transmission medium, and a short circuit prevention part which holds the conductive shell in a non-contact state with the connection terminal is provided on a surface of the conductive shell, and the short circuit prevention part is arranged to face an insulation portion of the flat signal-transmission medium inserted into the medium receiving space.

5. The plug connector according to claim 1, wherein in the conductive shell, a sliding contact elastic spring member which abuts on a side end surface of the flat signal-transmission medium in a plate width direction and bends elastically when the flat signal-transmission medium is inserted is provided.

6. The plug connector according to claim 5, wherein the sliding contact elastic spring member is provided in one of the upper and lower shell pieces, and the sliding contact elastic spring member is arranged in a positional relation where the sliding contact elastic spring member interferes with the other of the upper and lower shell pieces when the pair of the upper shell piece and the lower shell piece are closed in a state where the flat signal-transmission medium is not inserted into the medium receiving space, and the sliding contact elastic spring member is displaced by the flat signal-transmission medium inserted into the medium receiving space up to a position where the sliding contact elastic spring member does not interfere with the shell piece of the other side, and thereby, the sliding contact elastic spring is configured not to interfere with the shell piece of the other side when the pair of the upper shell piece and the lower shell piece are closed in a state where the flat signal-transmission medium is inserted into the medium receiving space.

7. The plug connector according to claim 1, wherein a positioning part formed so as to project or become depressed in a plate width direction or a plate thickness direction of the flat signal-transmission medium is provided in the flat signal-transmission medium, and the retaining engaging pawl is configured to be engaged with the positioning part.

8. A method of manufacturing a plug connector, wherein two or more bodies of conductive shells according to claim 1 are connected and manufactured integrally.

* * * * *